US006582554B1

(12) United States Patent
Henricson et al.

(10) Patent No.: US 6,582,554 B1
(45) Date of Patent: Jun. 24, 2003

(54) CONTINUOUS DIGESTER HAVING A SECTIONED TOP SEPARATOR WITH MULTIPLE LIQUOR EXTRACTION PORTS

(75) Inventors: Kaj O. Henricson, Kotka (FI); C. Bertil Stromberg, Glens Falls, NY (US); Richard Laakso, Queensbury, NY (US); John F. Bolles, Queensbury, NY (US); Keith P. Vogel, Queensbury, NY (US); Patrick J. Sullivan, Argyle, NY (US)

(73) Assignee: Andritz Inc., Glens Falls, NY (US)

( * ) Notice: Subject to any disclaimer, the term of this patent is extended or adjusted under 35 U.S.C. 154(b) by 0 days.

(21) Appl. No.: 10/142,944

(22) Filed: May 13, 2002

(51) Int. Cl.[7] ..... D21C 3/26

(52) U.S. Cl. ..... 162/17; 162/19; 162/52; 162/232; 162/237; 162/239; 162/243

(58) Field of Search ..... 162/17, 19, 52, 162/41, 62, 232, 237, 239, 243, 249

(56) References Cited

U.S. PATENT DOCUMENTS

| | | | |
|---|---|---|---|
| 3,843,468 | A | 10/1974 | Laakso |
| 6,174,411 | B1 | 1/2001 | Laakso et al. |
| 6,332,954 | B2 | 12/2001 | Snekkenes |
| 6,361,649 | B1 | 3/2002 | Snekkenes |

*Primary Examiner*—Steven P. Griffin
*Assistant Examiner*—M. Halpern
(74) *Attorney, Agent, or Firm*—Nixon & Vanderhye, P.C.

(57) ABSTRACT

A method is disclosed for extracting liquor from a cellulose slurry for a continuous digester comprising the steps of: providing the cellulose slurry of liquor and chips of cellulose fiber material to a separator; extracting a first stream of liquor from the separator; extracting a second stream of liquor from the separator, where the second stream has an effective alkali (EA) concentration greater than the EA concentration of the first steam; outputting the first stream from the separator and outputting the second stream from the separator separately from the second stream, and outputting a condensed slurry from the separator to a digester vessel.

13 Claims, 4 Drawing Sheets

CONTINUOUS DIGESTER HAVING A SECTIONED TOP SEPARATOR WITH MULTIPLE LIQUOR EXTRACTION PORTS

FIELD OF INVENTION

The invention relates to top separator devices for digesters used to process cellulosic fiber chips into pulp fibers. The invention particularly relates to top separators having two or more sections from which may be drawn cooking liquor of different concentrations.

BACKGROUND AND SUMMARY OF THE INVENTION

Digesters are pressure-cooking vessels used to process a slurry of cellulosic fibrous material, such as wood chips, and cooking liquor. The digester applies pressure and cooking liquor to process the chips into cellulose pulp fibers from which paper products may be made. A chip feed system supplies to the digester vessel a slurry of fiber chips and liquor. A top separator, generally in the top of the digester vessel, condenses the chip slurry from the chip feed system by extracting a portion of the liquor from the slurry.

A continuous digester generally includes a pressure vessel that is fully or partially filled with a slurry of the cellulosic fiber chips and cooking liquor. Wood chips, or other comminuted cellulosic fibrous material, are typically fed to the inlet of a continuous digester using the chip feed system, e.g., a wood chip slurry feed system. The feed system typically includes equipment for de-aerating, heating, steaming, pressurizing, and adding cooking liquor to the chips before transferring the slurry of chips and liquor to the digester vessel. In a hydraulic digester, the vessel is completely filled with a slurry that is under pressure and heat in the vessel. In a vapor-phase digester, the chip slurry is introduced to a pressurized gas space at an upper interior portion of a vessel. The lower portion of the vessel is filled with the chip slurry. A top separator concentrates the slurry by providing a means of removing liquid from the slurry, and distributes the slurry into the upper section of the digester vessel. From the top separator, the chips are processed in the digester vessel in a conventional manner.

The top separator removes cooking liquor from the slurry and distributes the wood chips to the digester vessel. A top separator typically includes a screw conveyor. The slurry of chips and liquor are fed to the conveyor, via a conduit that is connected to an external chip feed system. In the top separator as the chip slurry is carried by the screw conveyor, some of the liquor in the slurry is extracted out of the conveyor through a screen drum. The screen drum surrounds the screw conveyor to allow liquor to flow out of the chips being conveyed to the top of the separator. The liquor is conventionally extracted in a single stream from the screen drum of a top separator. Liquor may also be added to the slurry in the separator. The screen drum of the separator may be divided to provide a chamber to collect liquor from the slurry and another chamber(s) to introduce liquor through the screen into the slurry, as is shown in U.S. Pat. Nos. 6,332,954 and 6,361,649. However, these patents do not disclose or suggest extracting multiple streams of liquor from a top separator.

SUMMARY OF INVENTION

There is a need to extract multiple streams of liquor from a top separator. The multiple streams each have a different effective alkali (EA) concentration. There are requirements in the digester and chip feed system for liquor streams having various levels of EA. There is a long-felt need for a ready source of multiple streams of liquor having various EA levels. These requirements for liquor streams having multiple levels of EA can be satisfied, at least in part, by extracting multiple streams from a top separator.

In one embodiment, the invention is a top separator for a vapor-phase or hydraulic digester having a liquor extraction compartment divided into multiple chambers to allow for the extraction of multiple liquor streams each having a different EA concentration. These liquor streams extracted from the top separator are routed to various applications in the chip feed system, digester vessel or other sections of a pulp processing system.

At the screw output of the top separator, the remaining condensed slurry, i.e., the slurry with a portion of the liquor removed, containing the wood chips is fed from the top separator to other portions of the digester vessel. Additional liquor may be introduced to the vessel at or just below the top separator. This additional liquor may be drawn from one of the chambers of the top separator.

In another embodiment, the invention is a method for extracting liquor from a cellulose slurry for a continuous digester comprising the steps of: providing the cellulose slurry of liquor and chips of cellulose fiber material to a separator; extracting a first stream of liquor from the separator; extracting a second stream of liquor from the separator, where the second stream has an effective alkali (EA) concentration greater, typically at least 5 gr (as NaOH) EA/1 greater but preferably more than 10 gr (as NaOH) EA/1 greater, than the EA concentration of the first steam; outputting the first stream from the separator and outputting the second stream from the separator separately from the second stream, and outputting a condensed slurry from the separator to a digester vessel.

In a further embodiment, the invention is a method for extracting liquor from a cellulose slurry for a continuous digester comprising the steps of: providing the cellulose slurry of liquor and chips of cellulose fibrous material to a separator; extracting a first stream of liquor from the separator; extracting a second stream of liquor from the separator, where the second stream has a temperature greater, typically at least 7° C. warmer (and preferably 15° C. warmer), than the temperature of the first stream; outputting the first stream from the separator and outputting the second stream from the separator separately from the second stream, and outputting a condensed slurry from the separator to a digester vessel.

In another embodiment the invention is a separator for a continuous digester in a cellulose fiber processing system comprising: an inlet receiving a slurry having fiber chips and liquor; a slurry conveyor having a slurry flow path, including a first path portion near the inlet, and a second path portion near a slurry outlet to the conveyor; where the slurry outlet is downstream of the slurry flow path and provides condensed slurry to a digester vessel; a screen adjacent the conveyor and arranged along the flow path, wherein the screen is porous to allow passage of liquor and block fiber chips; a first liquor chamber adjacent the first path portion and on a side of the screen opposite to the conveyor; a second liquor chamber adjacent the second path portion and on a side of the screen opposite to the conveyor; a first liquor stream outlet coupled to the first liquor chamber, and a second liquor stream outlet coupled to the second liquor chamber.

In a further embodiment the invention is a separator for a continuous digester in a cellulose fiber processing system comprising: an inlet receiving a flow of a fiber chip and liquor slurry; a screw conveyor having a slurry flow path along a screw axis, including a first screw portion near the inlet, and a second screw portion near a slurry outlet to the conveyor; said slurry outlet being downstream of the slurry flow path and providing a condensed slurry to a digester vessel; a cylindrical screen coaxial to the conveyor and arranged along the flow path, wherein the screen is porous to allow passage of liquor and block fiber chips; a first annular liquor chamber adjacent the first screw portion and having the screen forming an inner wall to the chamber; a second liquor chamber adjacent the second screw portion and having the screen forming an inner wall to the chamber; a first liquor stream outlet coupled to the first liquor chamber, and a second liquor stream outlet coupled to the second liquor chamber.

BRIEF DESCRIPTION OF THE DRAWINGS

Several embodiments of the invention are illustrated in the attached drawings which are.

DETAILED DESCRIPTION OF THE DRAWINGS

Figure 1:
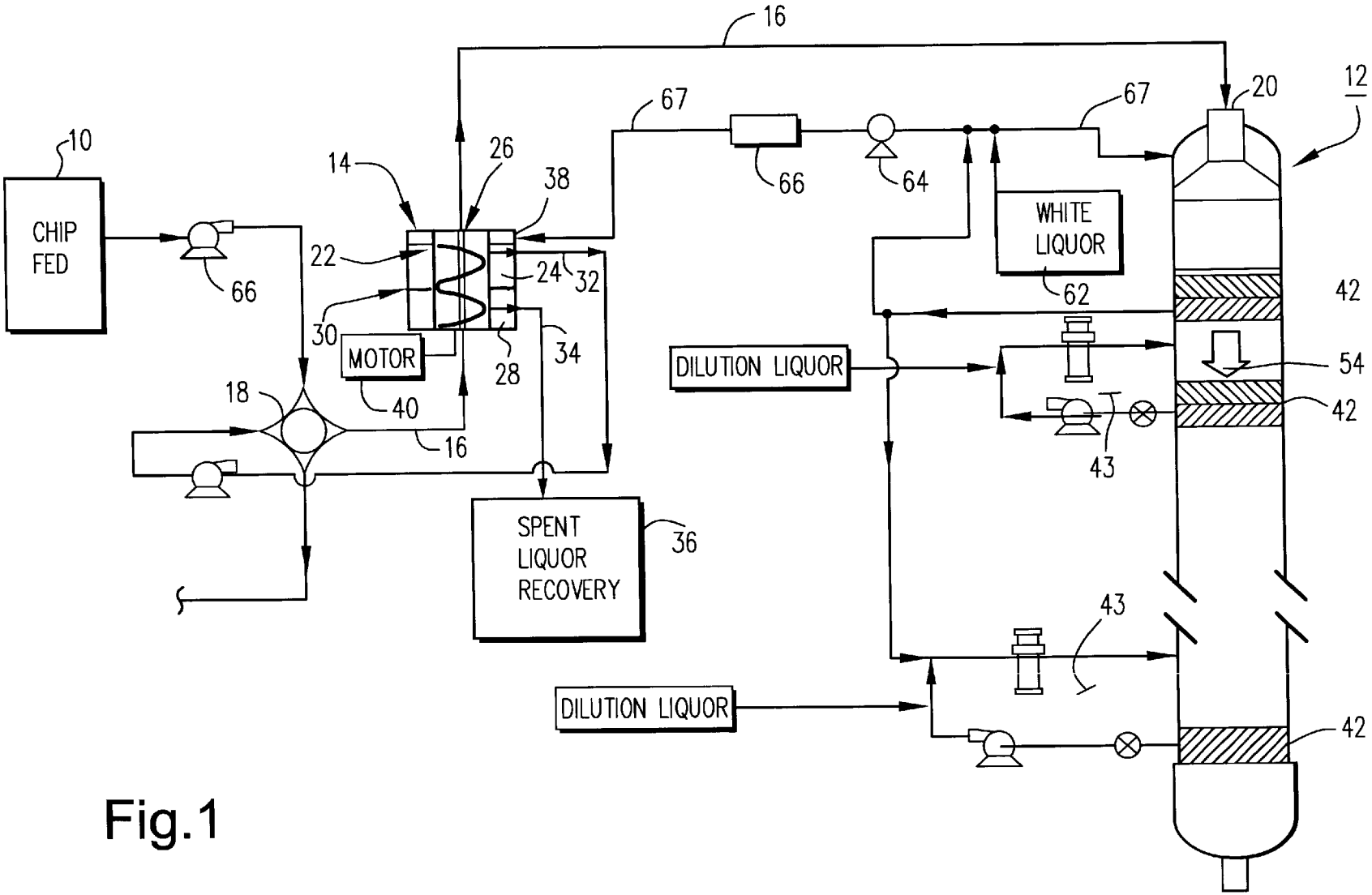
FIG. 1 is a schematic side view, partly in cross section and partly in elevation, of an inlet and upper section of a chip feed and digester system, having a separator with multiple extraction streams.

FIG. 1 illustrates a chip feed system 10 and a continuous digester 12, having a separator 14. The digester 12 may be a single digesting vessel in a pulping system, or may be one of two or more vessels, where another vessel may be an impregnation vessel. The digester may be a hydraulic pressure vessel with an external or internal separator, or a vapor phase digester with an inverted top separator. FIG. 1 shows a hydraulic digester with an external separator 14. The digester 12 typically receives from the feed system 10 a slurry of comminuted cellulosic fibrous chip material, typically wood chips, mixed with cooking liquor, such as kraft white liquor. The slurry is typically first treated in a feed system 10, for example, a Lo-Level™ feed system as sold by Andritz Inc. of Glens Falls, N.Y.

The separator 14 is located in a pressurized slurry conduit 16 connecting a high-pressure feeder 18 to the top 20 of the digester vessel 12. The separator 14 includes a cylindrical screen basket 22 that provides a porous barrier between the slurry passing through a screw conveyor 26 of the separator and the liquid collection chambers 24, 28 that annularly surround the conveyor. There is at least an upper cylindrical screen chamber 24 around an upper portion of the screw conveyor 26 and a lower cylindrical screen chamber 28 around a lower portion to the conveyor. Each screen chamber 24, 28 has an output for a respective extraction stream 32, 34.

An annular baffle disk 30 separates the upper 24 and lower 28 chambers of the screen basket 22. The disk has an inner circumference adjacent the screen basket 22 and an outer circumference adjacent an outer wall of the separator. The baffle disk 30 may be loose fitting so as to allow for some of the liquor in the upper chamber to flow to the lower chamber and vice versa. Allowing some cross flow of liquor between the chambers 24, 28 allows for uniform liquor pressure in the two chambers, and avoids one chamber from lacking sufficient liquor while the other chamber has liquor. The position of the disk 30 along the length of the screw is selected to separate the extracted liquor streams at the desired EA and/or temperature levels. Multiple disks 30 may be used to define more than two chambers around the screw conveyor 26.

The multiple liquid collection chambers, 24, 28, each have an output so that multiple liquor streams 32, 34 can be withdrawn from the top separator. The screen chambers 24, 28 may be two or more cylindrical compartments around the screw. The chambers are stacked one over the other along the conveyor length. The effective alkali (EA) in the slurry is consumed by the chip fibers and the EA content of the slurry lessens as it passes through the separator, unless white liquor with a high EA is added to the slurry. The first stream 34 in the separator shown in FIG. 1 has a relatively low EA, typically below 15 gr (as NaOH) EA/1, and preferably below 8 gr (as NaOH) EA/1, as it taken from the chamber 28 that is near the input of the external separator 14. The first stream 34 may be send to a spent liquor recover system 36.

The second withdrawal stream 32, taken from a chamber 24 near the separator outlet, has a higher in EA concentration the liquor collected in the chamber 28. The second extracted stream 32 may be returned to the high-pressure feeder 18 of the chip feed system and reintroduced into the slurry. By reusing in the chip feed system the liquor extracted from the top separator with relatively high EA, the liquor with high EA is in maintained in contact with the wood chips and does not flow to the recovery system 36.

Additional liquor may be supplied at port 38. The supplied liquor may include additives to enhance the pulping chemistry in the digester vessel. New (white) liquor may be introduced at a port 38 near the outlet end of the separator 14. This new liquor becomes part of the slurry output from the separator and entering the digester treatment vessel 12 via conduit 16. Additionally, a portion of this liquor may be mixed with the slurry liquor and become stream 32 extracted from section 24.

The separator 14 may include a screw conveyor 12 and drive shaft for the conveyor. The drive shaft may be driven by an electric motor 40 or other power mechanism. As the slurry is transported through the screw conveyor 26, the slurry is mixed by the screw and slides against the interior cylindrical surface of the screen 22. Liquor from the slurry passes through the cylindrical screen 22 and is collected in screen chambers 24, 28 adjacent to the screen. The porous mesh of the screen is sufficiently fine to prevent chips from passing through the screen.

The condensed slurry of chips and liquor discharged from separator 14 pass through the conduit 16 and enter the digester vessel 12 for further processing into cellulosic fibers. In the vessel, the chips are immersed in cooking liquor as they pass downward into the digester vessel,) where the cooking process continues. Screens 42 (at various levels in the liquid portion of the digester) may be used in a conventional manner to remove black cooking liquor from the chips flowing downward through the vessel of the digester. Additional cooking liquor 62 may be injected into the digester, usually near the top of the digester using line 67. In addition, diluted liquor may be extracted from the vessel or from other steps in the pulping process, and reintroduced to the vessel or diverted for other uses (see process 43). In addition, the flow (see arrow 45) of the chip slurry through the vessel is generally downward. At the bottom of the vessel, digested fiber pulp is output along line 47.

Figure 2:
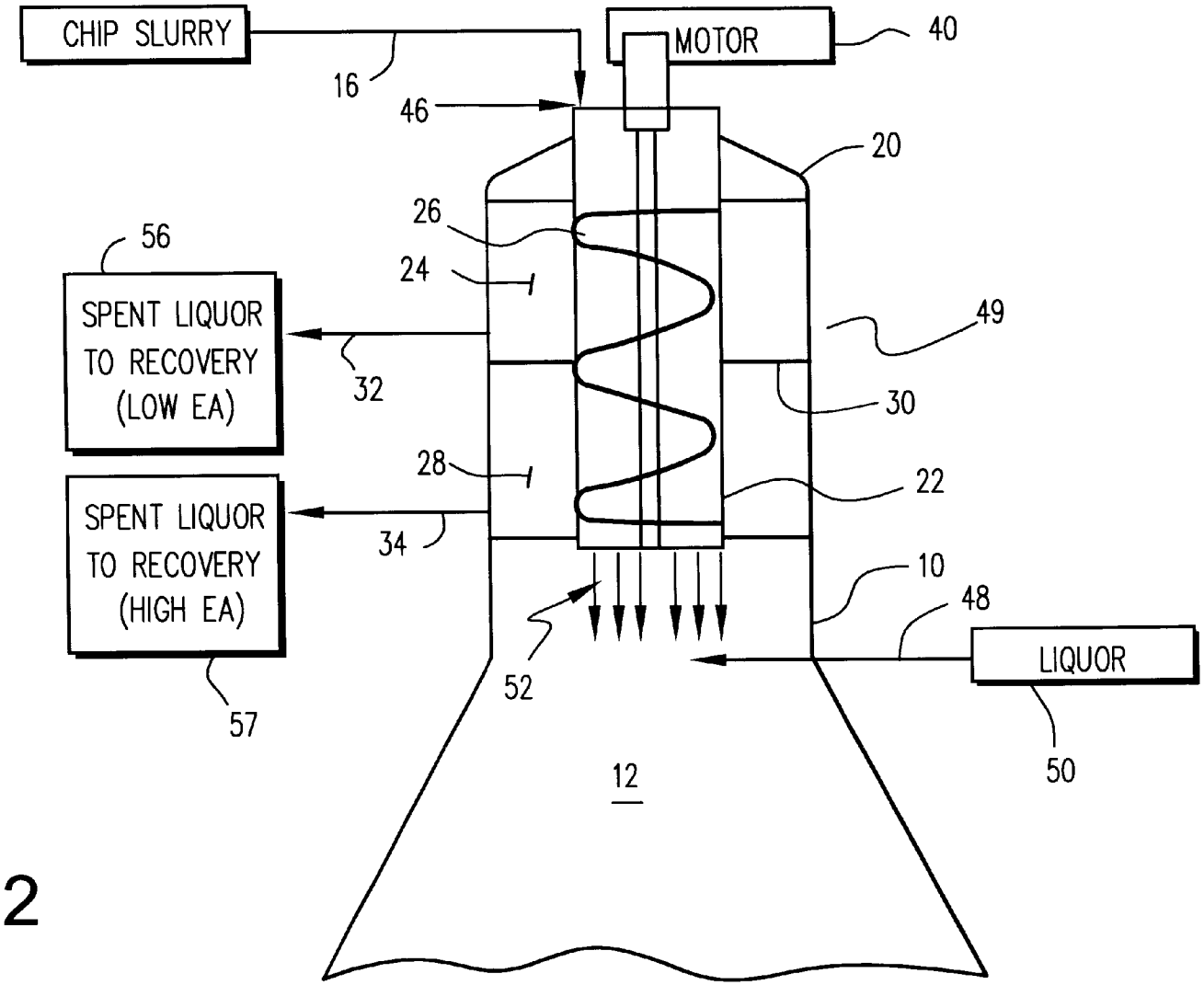
FIG. 2 is an enlarged side view of a top separator with multiple liquor extraction streams.

FIG. 2 shows an enlarged view of a second top separator 49 mounted within in the top section 20 of a hydraulic digester 12. The motor 40 for the screw conveyor may be mounted on the top of the vessel. The separator has an inlet 46 connected to a slurry conduit 16. A conduit 48 for supplying additional liquor to the digester vessel immediately downstream of the top separator may be connected to a supply of liquor 50, such as white liquor, filtrate or black liquor.

The white liquor with high EA added through conduit 48 will mix with the slurry in the lower portion of the separator and thereby raise the EA of the liquor in the lower chamber 28 of the top separator 49. The collected liquor in the upper chamber 24 will have a lower EA than the liquor collected in the lower chamber 28, due to the injection of white liquor via conduit 48.

In the embodiment shown in FIG. 2, the topmost extracted stream 32 has a relatively lower EA concentration. This stream 32 may account for approximately 25% to 50% of the total liquor flow extracted from the top separator, and the other stream 34 accounts for 75% to 50% of the total flow. The first stream 32 may have an EA concentration and temperature to allow it to be sent for evaporation via the recovery system 56.

The lower (or second) extracted stream 34 has a higher EA concentration and the concentration may be at a level sufficient for reuse 57. The higher EA concentration stream 34 can be used elsewhere within the process, for example returned to the feed system. By returning the stream to the feed system, the valuable alkali is contacted with the wood chips and consumed. In this example, the bottom stream 34 may be in communication with the top stream 32, e.g., via the loose fitting divider 30, without adversely impacting the operation of the top separator or the collection of different streams of liquor.

The separator 49 includes a cylindrical side screen 22 that allows excess liquid from the chip slurry to be removed as the chips move through the screw conveyor 26. The separator 22 is the screw conveyor 26 that moves the chips as they are received through the top inlet 46. Chips are discharged from the outlet of the screw conveyor, as indicated by arrow 52.

Figure 3:
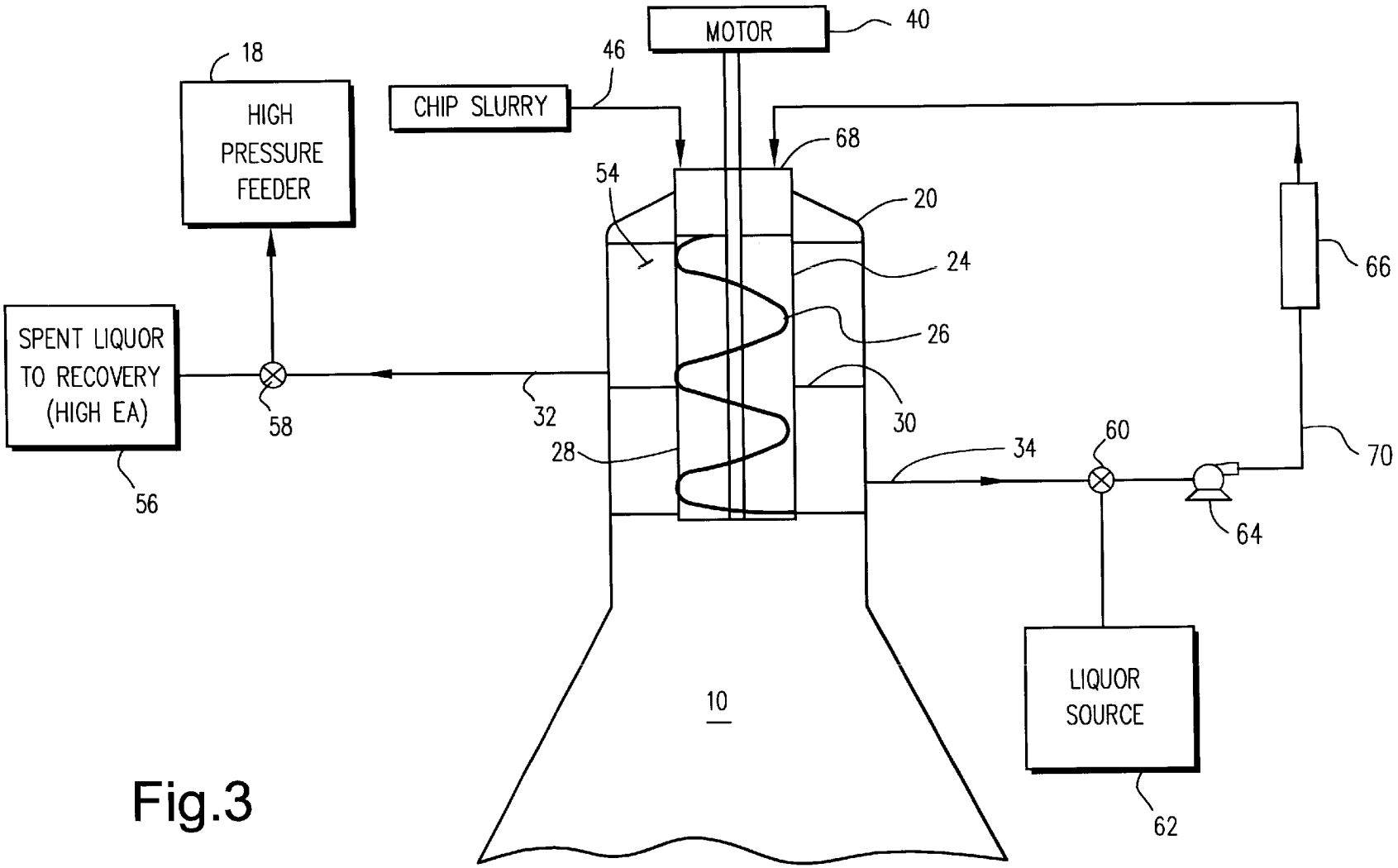
FIG. 3 is an enlarged side view of a second embodiment of a top separator.

FIG. 3 is an illustration of another embodiment of a top separator 54. The top separator 54 shown in FIG. 3 is similar to the separator 49 shown in FIG. 2. However, the extracted streams 32, 34 in separator 54 flow to recovery, high-pressure feeder and to the top of the separator. In a hydraulic digester 10, the upper extracted stream 32 may have an EA concentration sufficiently low so as to allow the stream to flow to evaporation via the recovery system 56. Depending on the EA concentration level, the first stream 32 may also flow to the high pressure feeder 18 of the chip supply system. The portion of the first stream flowing to the recovery system and the portion flowing to the feeder 18 may be regulated by a valve 58.

In this hydraulic digester example (FIG. 3), the lower (or second) extracted stream 34 may have a sufficiently high EA concentration such that it can be used elsewhere within the pulping process, for example by being returned to the feed system (as shown in FIGS. 1 and 2). If the lower stream 34 has a low EA concentration (such as even lower than the EA concentration of the first stream 32), the addition of white liquor to the stream 34 will increase the EA concentration such that the combined stream 59 can be reused in the pulping process. For example, the second stream 34 (combined with white liquor 62) may flow to the inlet of the top separator, as shown in FIG. 3.

In particular, the second stream 34 flows to a mixing valve 60 where the stream may receive additional liquor having a high EA concentration, such as from a white liquor source 62. The combined stream 59 is pumped via pump 64 and may be heated via heater exchanger 66 before it is introduced via an inlet 68 to the top separator. In this example, the white liquor conventionally introduced to the vessel at a point just below the top separator could be introduced into the circulation loop 70 and ultimately to the top of the vessel.

Figure 4:
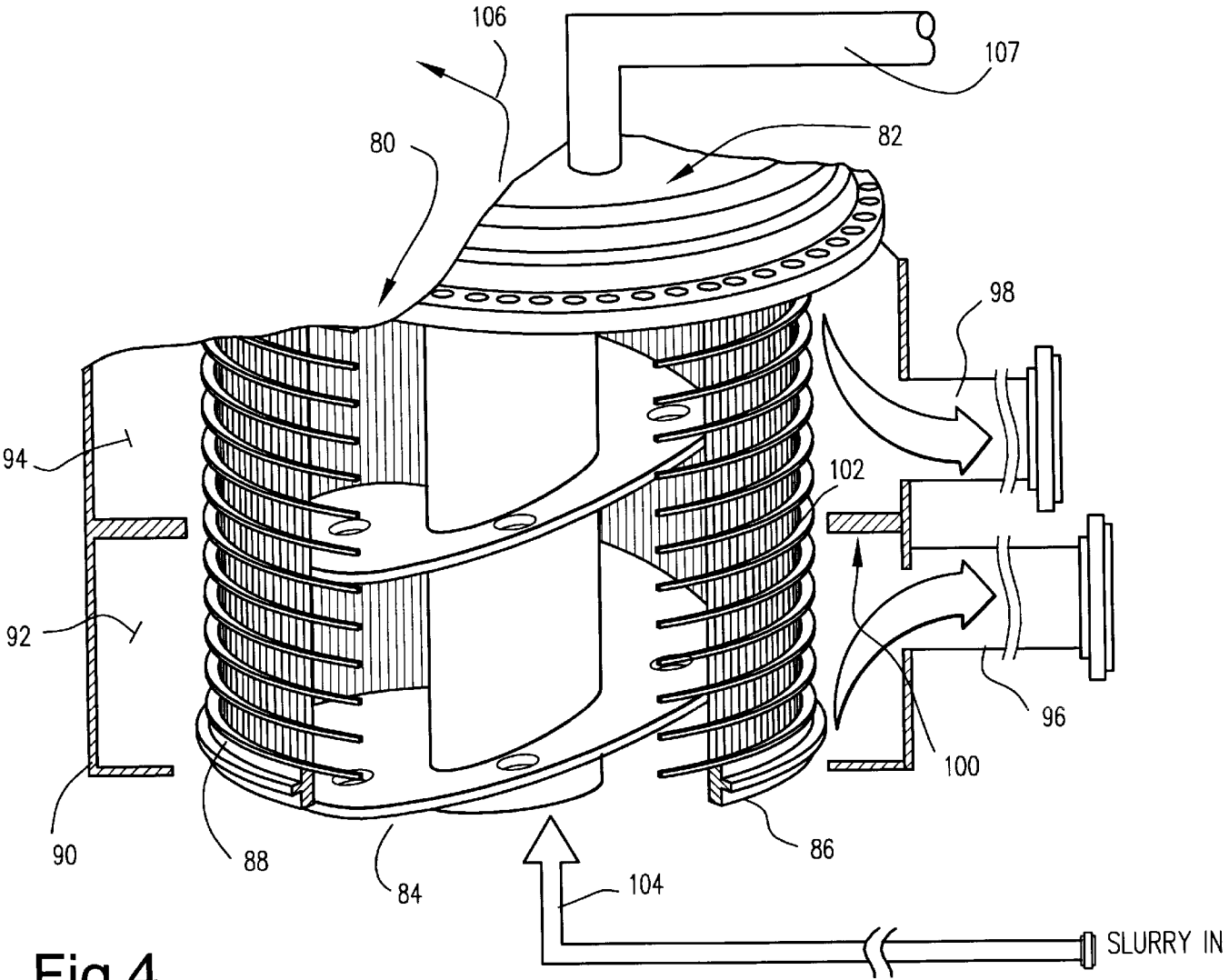
FIG. 4 is an enlarged side view with a partly cut-out section of a bottom inlet liquor injection device for an inverted top separator.

FIG. 4 is an illustration of an inverted top separator 80 installed in the upper portion 82 of a vapor phase digester vessel. Chip slurry enters the inverted top separator through line 104. The top separator 80 includes a bottom inlet screw 84 driven by a top-mounted motor (not shown). The screw is surrounded by a cylindrical screen 86 having a plurality of support rings 88. The screw and cylindrical screen are encased in a cylindrical housing 90, which is shown in cross-section in FIG. 4.

The housing 90 includes a first annular liquid collection chamber 92, and a second annular liquid collection chamber 94. The two annular liquid collection chambers 92, 94 each have an interior surface formed by the screen cylinder 88. Each chamber receives liquor flowing through the screen from the slurry of chips and liquor being moved vertically upwards by the screw 84. Each liquid collection chamber 92, 94 includes a respective extraction output 96, 98 for the collected liquor in the chambers to be removed.

The chambers 92, 94 are separated by an annular disk baffle 100 that may be affixed to the wall of the housing 90 and extend radially inwardly towards the screen cylinder 88. The inner circumference of the baffle 100 may not abut against the screen cylinder 88. A gap 102 between the inner circumference of the baffle 100 and the screen allows liquor collected in the chamber 92 flow to chamber 94, and vice-versa.

The chips leaving the top of the screw fall as shown by 106 into the digester. At the top or upper portion of the top screw, white liquor or black liquor high in EA may be added via line 107 to raise the EA of the chip slurry to a level suitable for cooking, typically 20–70 gr (as NaOH) EA/1. Part of this added EA will be mixed with the liquid surrounding the chips and be extracted through conduit 98, this liquid is suitable for use elsewhere in the feed or cooking system. The liquid extracted from a lower point in the top separator, for example conduit 96, will, however, be relatively unaffected by the liquor added to the top separator and can be taken to recovery or reused in another location suitable for a stream low in EA concentration. It is thus possible to use a top screw in a vapor phase digester to separate out a liquor 96 low in EA (below 15 gr (as NaOH)EA/1, preferably below 10 gr (as NaOH)EA/1), add liquor high in EA to the top of the screw and mix it with the chips so that the resulting chips are high in EA when the digester from further treatment such as cooking. The liquor 98 is higher in EA concentration than stream 96 and therefore can be used elsewhere to recover the EA in the liquid.

The preferred embodiments of the invention, as now known by the inventors, are fully described here in sufficient detail such that one of ordinary skill in the art is able to make and use the invention using no more than routine experimentation. The embodiments disclosed herein may not be all of the possible embodiments of the invention. Other embodiments of the invention that are within the sprite and scope of the claims are also covered by this patent.

What is claimed is:

1. A method for extracting liquor from a cellulose slurry of a continuous digester comprising of:

providing the cellulose slurry of liquor and chips of cellulose fiber material to a separator;

extracting a first stream of liquor from the separator;

extracting a second stream of liquor from the separator, where the second stream has an effective alkali (EA) concentration greater than the EA concentration of the first stream;

outputting the first stream from the separator and outputting the second stream from the separator separately from the first stream, and outputting a condensed slurry from the separator to a digester vessel.

2. A method for extracting liquor as in claim 1 wherein the separator is external to a digester vessel.

3. A method for extracting liquor as in claim 1 wherein the separator is internal to a digester vessel.

4. A method for extracting liquor as in claim 1 wherein the output of the first stream flows to a spent liquor recovery system.

5. A method for extracting liquor as in claim 1 wherein the output of the second stream flows to a chip feed system to be added to the slurry upstream of the separator.

6. A method for extracting liquor as in claim 1 wherein the output of the second stream flows to a high pressure feeder in a chip feed system to be added to the slurry upstream of the separator.

7. A method for extracting liquor as in claim 1 wherein the output of the second stream flows to an inlet to the separator and is added to the slurry flowing into the separator.

8. A method for extracting liquor as in claim 1 wherein the output of the second stream is mixed with white liquor to form a liquor mixture that flows to an inlet to the separator and is added to the slurry flowing into the separator.

9. A method for extracting liquor as in claim 8 wherein the mixture is heated before flowing to the inlet to the separator.

10. A method for extracting liquor as in claim 1 wherein the separator includes a screw conveyor, a screen cylinder, and a first chamber and a second chamber each adjacent to the screen cylinder, wherein the first stream is extracted from the first chamber and the second stream is extracted from the second chamber.

11. A method for extracting liquor as in claim 10 wherein the first chamber is upstream along the screw conveyor to the second chamber.

12. A method for extracting liquor as in claim 1 wherein the first stream is combined with additional liquor having a high EA concentration, and the combine stream flows to the slurry inlet of the separator.

13. A method for extracting liquor as in claim 1 wherein the second stream has an EA at least 5 gr (as NaOH) EA/1 greater than the EA concentration of the first stream.

* * * * *